US012319885B2

(12) United States Patent
Tsukamoto

(10) Patent No.: US 12,319,885 B2
(45) Date of Patent: Jun. 3, 2025

(54) LUBRICANT COMPOSITION FOR FORMING HEMIMORPHITE-CONTAINING LUBRICATION COATING, METHOD FOR FORMING SAID LUBRICATION COATING ON SURFACE OF METAL WORKPIECE, AND METAL WORKPIECE COMPRISING SAID LUBRICATION COATING

(71) Applicant: O&K Company, Higashiosaka (JP)

(72) Inventor: Tetsuya Tsukamoto, Yokohama (JP)

(73) Assignee: O&K COMPANY, Osaka (JP)

( * ) Notice: Subject to any disclaimer, the term of this patent is extended or adjusted under 35 U.S.C. 154(b) by 0 days.

(21) Appl. No.: 17/798,142

(22) PCT Filed: Feb. 8, 2021

(86) PCT No.: PCT/JP2021/004668
§ 371 (c)(1),
(2) Date: Aug. 8, 2022

(87) PCT Pub. No.: WO2021/157745
PCT Pub. Date: Aug. 12, 2021

(65) Prior Publication Data

US 2023/0077757 A1 Mar. 16, 2023

(30) Foreign Application Priority Data

Feb. 6, 2020 (JP) ..... 2020-019229

(51) Int. Cl.
*C10M 103/06* (2006.01)
*C10M 103/04* (2006.01)
(Continued)

(52) U.S. Cl.
CPC ..... *C10M 103/06* (2013.01); *C10M 103/04* (2013.01); *C10M 125/10* (2013.01);
(Continued)

(58) Field of Classification Search
CPC ..... C10M 103/06; C10M 103/04; C10M 125/10; C10M 129/40; C10M 173/00;
(Continued)

(56) References Cited

U.S. PATENT DOCUMENTS 3,783,034 A * 1/1974 Kitayama ..... H01F 1/18 72/46
3,793,073 A * 2/1974 Kitayama ..... H01F 27/245 428/141
(Continued)

FOREIGN PATENT DOCUMENTS

CN 103964752 A 8/2014
CN 106145691 A 11/2016
(Continued)

OTHER PUBLICATIONS

Funami et al., "Effect of Zinc Phosphate Coating on Delayed Fracture", Journal of the Society of Materials Science, Japan, Jan. 1994, vol. 43, No. 484, pp. 29-35, cited in Specification, w/English abstract (7 pages).
(Continued)

*Primary Examiner* — Cephia D Toomer
(74) *Attorney, Agent, or Firm* — WHDA, LLP

(57) ABSTRACT

Problems addressed by the present invention are to provide a lubricant composition that is capable of being used as an alternative to chemical conversion treatment by means of phosphate, to provide a lubricant composition having practical stable lubricative performance without the need for additional unwanted operations, and to provide a method for using this to form a lubrication coating, and a metal workpiece at which a lubrication coating is formed on a surface thereof. Provided as a means for solving such problems is a lubricant composition for causing formation of a hemimorphite-containing lubrication coating that contains a silicate
(Continued)

compound (e.g., colloidal silica) and water-soluble zinc in solution.

11 Claims, 3 Drawing Sheets

(51) Int. Cl.

| | |
|---|---|
| ***C10M 125/10*** | (2006.01) |
| ***C10M 129/40*** | (2006.01) |
| ***C10M 173/00*** | (2006.01) |
| ***C10M 177/00*** | (2006.01) |
| *C10N 10/04* | (2006.01) |
| *C10N 10/08* | (2006.01) |
| *C10N 20/00* | (2006.01) |
| *C10N 20/06* | (2006.01) |
| *C10N 30/06* | (2006.01) |
| *C10N 40/20* | (2006.01) |

(52) U.S. Cl.
CPC ..... *C10M 129/40* (2013.01); *C10M 173/00* (2013.01); *C10M 177/00* (2013.01); *C10M 2201/053* (2013.01); *C10M 2201/062* (2013.01); *C10M 2201/1023* (2013.01); *C10M 2207/125* (2013.01); *C10N 2010/04* (2013.01); *C10N 2010/08* (2013.01); *C10N 2020/06* (2013.01); *C10N 2020/091* (2020.05); *C10N 2030/06* (2013.01); *C10N 2040/246* (2020.05)

(58) Field of Classification Search
CPC ..... C10M 177/00; C10M 2201/053; C10M 2201/062; C10M 2201/1023; C10M 2207/125; C10N 2010/04; C10N 2010/08; C10N 2020/06; C10N 2020/091; C10N 2030/06; C10N 2040/246
See application file for complete search history.

(56) References Cited

U.S. PATENT DOCUMENTS

| | | | |
|---|---|---|---|
| 5,928,796 | A | 7/1999 | Heimann et al. |
| 2019/0211456 | A1* | 7/2019 | Yasui ..... C10M 143/04 |

FOREIGN PATENT DOCUMENTS

| | | | |
|---|---|---|---|
| EP | 2 128 092 | A1 | 12/2009 |
| JP | 32-3711 | B | 6/1957 |
| JP | 47-9016 | A | 5/1972 |
| JP | 5-140759 | A | 6/1993 |
| JP | 5-140761 | A | 6/1993 |
| JP | H05140761 | * | 6/1993 |
| JP | 5-195233 | A | 8/1993 |
| JP | 5-195252 | A | 8/1993 |
| JP | 9-286995 | A | 11/1997 |
| JP | 10-36876 | A | 2/1998 |
| JP | 10-509469 | A | 9/1998 |
| JP | 11-130985 | A | 5/1999 |
| JP | 2000-86810 | A | 3/2000 |
| JP | 2002-363593 | A | 12/2002 |
| JP | 2011-246684 | A | 12/2011 |
| JP | 2014-43537 | A | 3/2014 |

OTHER PUBLICATIONS

International Search Report dated Mar. 16, 2021, issued in counterpart International Application No. PCT/JP2021/004668 (3 pages).

* cited by examiner

LUBRICANT COMPOSITION FOR FORMING HEMIMORPHITE-CONTAINING LUBRICATION COATING, METHOD FOR FORMING SAID LUBRICATION COATING ON SURFACE OF METAL WORKPIECE, AND METAL WORKPIECE COMPRISING SAID LUBRICATION COATING

TECHNICAL FIELD

The present invention relates to a method in which a lubricant composition suitable for carrying out plastic working is made to adhere to a surface of a steel rod or other such metal material to cause formation of a lubrication coating on a surface of a metal workpiece, to a lubricant composition for forming such lubrication coating, and to a metal workpiece having a lubrication coating.

BACKGROUND ART

When plastically working steel stock or other such Metal material, material surface(s) are subjected to lubrication treatment to prevent direct metal contact from occurring between work tools and metal material. In particular, where lubrication is being carried out in situations in which there are stringent forming conditions such as during cold forging or the like in which forming operations are carried out at normal temperature without carrying out heating of the material, it is sometimes the case that lubricative performance is inadequate where lime soaps, resins, or forging oils made to have some extreme pressure characteristics or the like are employed.

For example, with lime soaps, because coating adhesion is insufficient and these tend to be shed off therefrom, it is sometimes the case depending on the circumstances that adequate lubricity cannot be achieved during forging, and these may be ill-suited for universal use.

Where cold forging is to be carried out, chemical conversion treatment as typified by phosphate coating treatment may therefore be employed. Treatments ("bonderization/lubricant carrier treatments") in which "soap treatment" is combined with "phosphate coating treatment" are also widely known as treatments for imparting lubricity (see Patent Reference No. 1).

Of course, where phosphate coating treatment (e.g., zinc phosphate coating treatment) is included among the operations that are carried out, not only will treatment operations be made more complicated but this will also result in an increased amount of waste material due to the large quantity of sludge that would be generated at the time of chemical conversion treatment. Also, because the water used for rinsing would contain phosphorous, zinc, nitrogen, and so forth, and because this would while still in that state not even be able to undergo wastewater treatment, operations that include phosphate coating treatment will have an impact, as there will be a large environmental impact associated with disposal thereof.

Furthermore, where zinc phosphate coating treatment is employed to form a coating that continues to adhere to the workpiece following forging and the workpiece is additionally subjected to heat treatment, heating will cause a portion of the phosphorous within the coating to diffuse into the steel of the workpiece. Diffusion of phosphorous will cause formation of a phosphorized layer at the surface layer (the phosphorization phenomenon). This being the case, there will be a tendency for corrosion to occur at phosphorized layer grain boundaries.

It so happens that there has in recent times been a tendency toward increase in strength at screws and bolts. There has therefore come to be concern about the possibility of encountering delayed fractures even with products such as screws and the like (see Nonpatent Reference No. 1).

Delayed fracture refers to a phenomenon in which there is sudden occurrence of brittle facture despite almost the complete absence of any apparent plastic deformation following passage of a time during which a high-strength steel part is in a state in which it is subjected to a static load stress. Although the mechanism by which delayed fracture occurs is still not completely understood and the causal factors associated therewith are thought to be complex, hydrogen plays some sort of role, and it is also influenced by the phosphorization phenomenon. In addition, the phosphorization phenomenon, which is one causal factor, is promoted by the diffusion of phosphorous into steel that occurs when a phosphate coating is subjected to heat treatment.

As may be surmised from the fact that it is a coating capable of withstanding cold forging, once the phosphate coating has been formed, the coating will not be easily removed despite any attempt which may be made to remove it prior to carrying out heat treatment.

Because it is difficult to remove the phosphate coating after it has been formed, to avoid the phosphorization phenomenon and reduce factors that might otherwise cause occurrence of delayed fracture, there have been studies that have looked into whether it might be possible to employ for lubrication a lubrication coating that from the outset does not contain phosphorous.

For example, it has been proposed that the surface of stainless steel which is to be treated be covered and that potassium sulfate be employed as carrier agent for lubricant employed during wiredrawing of the treated stainless steel (see Patent Reference No. 2).

Of course, here as well, this would be beset with problems associated with occurrence of rust due to carbon dioxide gas in air or absorption of moisture during long-term storage following lubrication treatment. There is also the fact that the lubricant of this proposal would ordinarily need to be supplied by means of a separate operation. This being the case, because it would be impossible to employ an existing production line in the state in which it currently exists, and because it would be necessary for introduction thereof into a chemical conversion treatment line to undertake adjustment with respect to site layout and so forth, as it would be incapable of being substituted therefor in its existing state, it is inadequate for employment as an alternative means. And if in addition lubricant had to be supplied by means of a separate operation, because there would be a tendency for adhesion of lubricant to be become nonuniform, this would not be preferred from the standpoint of ability to stably obtain the desired lubricity.

And where a glass-type coating is employed, there would be a possibility that this might lead to bad plating during plating carried out in subsequent operation(s).

Next, with the goal of suppressing occurrence of rust, lubricants employing silicates as coating-forming agents have also been proposed (see, for example, Patent Reference No. 3).

But while these may have comparative ability to suppress occurrence of rust, silicates have a general tendency to be inferior with regard to lubricity. And because silicates that are employed as lubricants display marked absorption of moisture following application, there is a possibility that the lubricity thereof will decrease with passage of time. And where silicates are employed, because the coating will exhibit strong alkalinity, adsorption by the coating of carbon dioxide gas in air may result in a situation in which there is a change in lubricative performance and/or performance with respect to prevention of rust. In addition, as introduction of this method would require that lubricant be supplied by means of an operation different from existing operations, introduction thereof would reduce operational degrees of freedom.

Furthermore, a lubricant composition containing an alkali metal sulfate and an alkali metal borate as essential components, and further containing an alkali metal salt of a fatty acid, an alkaline earth metal salt of a fatty acid, a solid lubricant, and a water-soluble thermoplastic resin has been proposed (see Patent Reference No. 4). In accordance with this proposal, as carrier agent, there is presence of a borate which has a pH that is comparatively close to neutral in the lubricant.

When this is discarded, there will therefore be occurrence of the problem of the environmental impact of boron and so forth during wastewater treatment. And as was the case with silicates, because the problem of absorption of moisture thereby would be yet to be eliminated, there would be the possibility that the lubricity thereof would decrease with passage of time.

Now, where chemical conversion treatment such is carried out with phosphate coating is employed, occurrence of scum during lubrication treatment will not present all that large of a problem. However, with lubricants of the adsorption type, occurrence of scum will pose a larger problem operationally. Whereas with phosphates and other such chemical conversion solutions the treatment solution is acidic, because with silicates and the like the pH of the treatment solution is typically strongly alkaline, there is creation of ferrous hydroxide at the surface layer during treatment, this being due to the fact that there are cases in which reddening of product occurs. In addition, surfaces at which reddening has occurred will contain iron oxide and/or ferrous hydroxide. This being the case, because presence of iron oxide and/or ferrous hydroxide might result in local creation of electrochemical cells, and because there is the possibility that following lubrication treatment there might be further growth of rust, the possibility has existed that this would cause decrease in corrosion resistance.

PRIOR ART REFERENCES

Patent References

Patent Reference No. 1: Japanese Patent Application Publication Kokoku No. S32[1957]-3711

Patent Reference No. 2: Japanese Patent Application Publication Kokai No. H9[1997]-286995

Patent Reference No. 3: Japanese Patent Application Publication Kokai No. 2002-363593

Patent Reference No. 4: Japanese Patent Application Publication Kokai No. H10[1998]-36876

Patent Reference No. 5: Japanese Patent Application Publication Kokai No. H5[1993]-195233

Patent Reference No. 6: Japanese Patent Application Publication Kokai No. H5[1993]-195252

Nonpatent References

Nonpatent Reference No. 1: "Effect of Zinc Phosphate Coating on Delayed Fracture" by Kunio FUNAMI (Journal of the Society of Materials Science, Japan; Vol. 43, No. 484, pages 29-35; January 1994 volume)

SUMMARY OF INVENTION

Problem to be Solved by Invention

Lubrication employing chemical conversion treatment by means of phosphate has come to be widely and commonly used conventionally. Chemical conversion treatment by means of phosphate also exhibits excellent lubricative performance such as is capable of being employed in cold forging operations. Of course, because workpieces at which phosphate has been used for lubrication will be such that following heat treatment thereof the residual phosphorous component will enter into and diffuse throughout the steel, when viewed from a long-term perspective this constitutes a risk factor that can lead to occurrence of delayed fracture.

Various proposals with regard to stratagems involving lubricants other than phosphates have therefore been made, as mentioned above, in attempts to avoid employment of phosphates. However, such means have been fraught with concerns regarding decrease in lubricative performance, and regarding decrease in performance with respect to prevention of rust as a result of generation of rust due to absorption of moisture and the like. Furthermore, while it has not been possible for these to, simply and without modification, replace production lines in which there are operations for chemical conversion treatment by means of phosphate, as they cannot be introduced thereinto without undertaking troublesome procedures such as is the case when lubricant is imparted thereto via separate operation(s) or the like, there has been the problem that even after having been made to pass through such lubrication operations there has been a tendency for this to result in nonuniformity, and so it fair to say that these have remained inadequate in terms of their ability to serve as lubricants such as might replace phosphates.

In this regard, as a result of intensive research, the present inventor(s) were led to conceive of the idea that if a synthetic hemimorphite could be made to be present in a lubrication coating as a result of use of a lubricant composition capable of synthetic formation of a hemimorphite [$Zn_4(OH)_2Si_2O_7 \cdot H_2O$] having excellent lubricative performance, because it would be possible to obtain lubricity as a result of cleavage, lubricity such as might be favorably employed in metalworking and so forth might be obtained.

Of course, while hemimorphite is generally known as a natural mineral, with regard to artificially synthesized hemimorphite, a method by which it could be easily synthesized was not known. For example, the need to carry out unwanted additional operation(s) so that it might be made capable of being used to, simply and without modification, replace lubricants in conventional plastic working operations would limit the scope of application thereof at production sites.

But where working treatment time is short (within 10 minutes) such as at treatment operations during plastic working of metal with use of water-based lubricants, or during the course of use under low-temperature ambient conditions (e.g., not greater than 50° C.) such as during cold forging, artificial synthesis of hemimorphite during the course of such working treatment not being an easy matter, a method by which hemimorphite could be easily created in coating form at a surface under low-temperature ambient conditions in an extremely short amount of time was itself not known.

Note that while there are existing proposals that utilize hemimorphite with the goal of preventing rust (see Patent Reference Nos. 5 and 6; note that Patent Reference No. 6 is predicated upon an object in which a layer of zinc plating is present at a surface layer), the procedures employed at such means remain incapable of being described as simple, as they have been extremely troublesome. For example, not only because it would be necessary to impart the substrate with a zinc surface layer in advance but also because much time and temperature would be required for coating formation, there are limited situations and circumstances under which these could be employed. In addition, getting back to the question of how these would fare when evaluated as means for forming a rust prevention coating, these can hardly be described as adequate in terms of their practicality.

To obtain a lubricant composition capable of forming a practical lubrication coating employing hemimorphite, this would therefore have to be a lubricant composition such as would allow a simple manner of use that is suitable for operations employing lubricant compositions, such as would be capable of being suitably substituted in an existing situation in which a lubricant is employed, and this would moreover have to be a lubricant composition capable of causing a coating to be easily created at the surface of any of various metals including steel under low-temperature ambient conditions in a short amount of time.

It is therefore an object of the present invention to provide a phosphorous-free lubricant composition that does not employ phosphate and that is capable of being used as an alternative to conventional lubrication involving chemical conversion treatment by means of phosphate, which is a lubricant composition having practical stable lubricative performance that is capable of being used as an alternative to lubrication by means of a phosphate coating which is imparted prior to plastic working of metal without the need for additional unwanted operations, and which furthermore is a lubricant composition permitting formation of a lubrication coating containing a novel hemimorphite such as might be employed to replace a phosphate coating and such as will permit maintenance of excellent lubricity when a metal workpiece that has undergone plastic working is further subjected to cold forging or is otherwise plastically worked into a part or the like.

Means for Solving Problem

In this regard, as a result of further research, the present inventor(s) discovered that by causing water-soluble zinc at which zinc oxide has been dissolved by means of a chelating agent or water-soluble zinc involving zinc alkoxide at which zinc has been added to an alcohol and water-solubilized silicate or colloidal silica to be mixed in a certain ratio in solution, and causing additive(s) to be added as appropriate to facilitate reaction so that this might be used as a lubricant composition, after a solution of this lubricant composition was made to adhere to the surface of a metal material, it would be possible, by merely further carrying out cold plastic working such as will cause deformation of the steel wire or other such metal workpiece, to cause a lubrication coating containing artificially synthesized hemimorphite to be formed at the surface of said metal workpiece. That is, it was discovered that even when plastic working was carried out at low temperature and for a short amount of time, artificially synthesized hemimorphite ($Zn_4(OH)_2Si_2O_7 \cdot H_2O$) could be formed within the components of the lubrication coating that was formed, and this could be made to be present within the lubrication coating at the surface of a metal workpiece.

Because the coating containing synthetic hemimorphite that is formed has excellent lubricity, it is possible in accordance with the present invention to cause formation of a lubrication coating that exhibits adequate practical properties even as a lubricant composition for use when carrying out plastic working of metal. Natural hemimorphite is a mineral that exhibits perfect cleavage along the {110} plane, and that also exhibits cleavage along the {101} plane. In this regard, it is also the case where a coating that contains synthetic hemimorphite is formed that because a solid coating at the metal surface will likewise be such that the hemimorphite present therewithin will exhibit cleavage, this is why it is possible for satisfactory lubricity to be provided thereby at the surface of the metal workpiece.

Because the bonds of the crystal lattice are weak at cleavage planes, cleavage can occur easily when a force parallel to the direction of slippage acts thereon, and because the slippage propagates in laminar fashion, friction and wear is reduced, as a result of which seizing tends not to occur. When plastic working of the sort referred to as cold forging is imparted to a metal material, it will be possible cause the metal workpiece that has undergone working to be imparted with lubricity.

In this regard, a first means for solving the problems addressed by the present invention is a lubricant composition for causing formation of a hemimorphite-containing lubrication coating that contains a silicate compound and water-soluble zinc in solution.

Furthermore, a second means is the lubricant composition according to the first means wherein the silicate compound is colloidal silica.

A third means therefor is the lubricant composition according to the first or second means characterized in that a water-soluble polymer is further added thereto.

A fourth means is the lubricant composition according to any one of the first through third means characterized in that at least one of metal soap and/or polyethylene is further added thereto.

A fifth means is the lubricant composition according to any one of the first through fourth means characterized in that at least one of hydrated lime, calcium carbonate, molybdenum disulfide, and/or carbon is further added thereto.

A sixth means is the lubricant composition according to any one of the first through fifth means characterized in that at least one of nitrite and/or metal sulfonate is further added thereto.

A seventh means is a lubricant composition for causing formation of a hemimorphite-containing lubrication coating that contains hemimorphite.

An eighth means is the lubricant composition according to the seventh means characterized in that the hemimorphite is synthetic hemimorphite.

A ninth means is the lubricant composition according to any of the seventh and eighth means characterized in that the hemimorphite consists of particles for which the volume mean diameter thereof is not greater than 10 μm.

A tenth means therefor is the lubricant composition according to any one of the seventh through the ninth means characterized in that it contains gel-like synthetic hemimorphite.

An eleventh means therefor is a method wherein the lubricant composition according to any one of the first through tenth means is made to adhere to a surface of a metal material; and by then causing this metal material to undergo plastic working as a metal workpiece, a lubrication coating that contains hemimorphite is formed on a surface of the metal workpiece at a time when there is deformation as a result of the plastic working thereof.

A twelfth means is a method for forming a lubrication coating wherein a lubrication coating that contains hemimorphite is formed as a result of causing the lubricant composition according to any one of the seventh through tenth means to adhere to a surface of a metal workpiece and to be made to dry.

A thirteenth means therefor is a metal workpiece at which a lubrication coating that contains hemimorphite is formed at a surface thereof by means of the lubricant composition according to any of the first through tenth means.

Benefit of Invention

A lubricant composition of a means in accordance with the present invention can be conveniently made to adhere to the surface of a steel rod or other such metal material as a result of causing the metal material to be immersed therein, subjected to application thereby, and so forth. When a metal material at which the lubricant composition has been made to adhere to a surface thereof is subjected to plastic working and the metal workpiece is made to undergo plastic deformation, the lubricant composition adhering thereto is able to cause a coating that contains hemimorphite to be formed at the surface of the metal workpiece even at low temperatures due to pressure arising at the time of plastic deformation. It is therefore possible to conveniently cause the surface of a metal workpiece at which the lubricant composition has been made to adhere to be imparted with a lubrication coating. In addition, the lubrication coating produced by this lubricant composition exhibits excellent lubricative performance comparable to that of a phosphate coating.

Furthermore, because the lubricity of a metal workpiece having a hemimorphite-containing lubrication coating is high, this metal workpiece may further undergo cold forging or other such plastic working, as a result of which screws, parts, and/or various other such mechanical materials may be obtained.

Because it is possible merely by carrying out plastic working to cause a hemimorphite-containing lubrication coating to be formed at the surface of a metal material at which a lubricant composition in accordance with the present invention has been made to adhere, it is possible to obtain adequate lubricity at the surface of the metal workpiece, and it is at the same time moreover possible to cause this to also be imparted with rust preventability.

Furthermore, because hemimorphite is created at locations acted on by pressure from plastic working or the like, it is possible to use a lubricant composition in accordance with the present invention as a friction modifier to inhibit occurrence of seizure due to friction.

Furthermore, because when mixed with calcium ions which have excellent properties as carrier agent, a lubricant composition employing colloidal silica will be able to more readily cause retention of lubricant solution stability, the lubricant composition will be more stable than would be the case with potassium silicate or other such inorganic salt. This will therefore make it possible to more easily ensure the design latitude of the lubricant composition, which will tend to increase the range of situations in which lubricant compositions in accordance with the present invention are capable of being employed.

EMBODIMENTS FOR CARRYING OUT INVENTION

Figure 1:
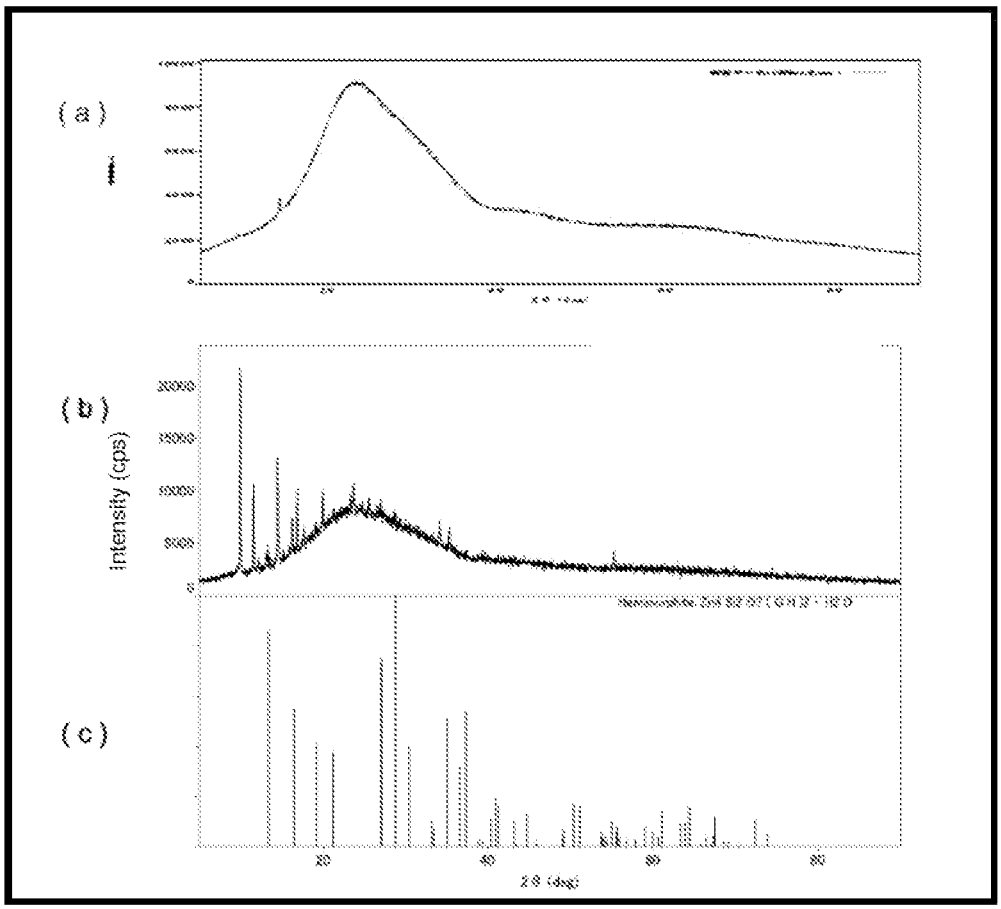
FIG. 1 Drawings showing results of measurement of x-ray diffraction before and after creation of synthetic hemimorphite. (a) is the result of measurement of residue dried during the stage before heating of solution when white gel-like substance had not been created. (b) is the result of measurement of dried white gel-like substance produced following heating for 18 hours. (c) is JCPDS data showing peaks of known hemimorphite.

Compositions of respective substances contained in solutions at lubricant compositions in accordance with the present invention will be described.

A lubricant composition in accordance with the present invention is a solution that contains (1) water-soluble zinc and (2) a silicate compound, a prime example of which would be colloidal silica. This (1) and this (2) are substances that are necessary for artificial creation of hemimorphite ($Zn_4(OH)_2Si_2O_7 \cdot H_2O$).

With regard to the blended ratio of these substances, the amounts of the water-soluble zinc and colloidal silica components may be adjusted in advance so as to cause these to be present in amounts such as will cause the molar ratio of Zn and Si to be in the ratio in which they are present in hemimorphite.

As the water-soluble zinc is the source of the Zn that is supplied for formation of hemimorphite, it is water-soluble. For example, where zinc oxide and the chelating agent EDTA (ethylenediaminetetraacetic acid) are used, because that which results from causing the zinc oxide to be dissolved in advance by the chelating agent is capable of being suitably used, it will also be moreover possible to favorably employ $EDTA \cdot Zn \cdot 2Na \cdot 3H_2O$ (Chelest Zn manufactured by Chelest Corporation) or the like. Furthermore, as water-soluble zinc, a water-soluble zinc compound or the like resulting from redissolution of zinc oxide by an acidic solution (e.g., nitric acid, sulfuric acid, acetic acid, hydrochloric acid, or an organic acid or the like) may be used.

Silicate compound refers, for example, to waterglass (sodium silicate) or sodium-silicate-derived wet silica, dry silica, precipitated silica, silica gel, colloidal silica, or the like which is water soluble or is dispersible in solution. As the silicate compound is the source of the Si that is supplied for formation of hemimorphite, it is necessary.

Colloidal silica is a colloid of $SiO_2$ or a hydrate thereof, and is also referred to as colloid-like silica. Colloidal silica consists of particles having excellent dispersion characteristics which when in a sol state at room temperature do not readily precipitate. It may be obtained by methods which employ inexpensive waterglass as raw material, liquid-phase synthetic methods of the sort referred to as alkoxide hydrolysis, gas-phase synthetic methods such as aerosil synthesis involving pyrolysis of silicon tetrachloride, and so forth.

Because what is referred to as colloidal silica in the context of the present invention is thus colloidal silicon dioxide, it includes fumed silica. It is preferred that it be a colloidal silica permitting use of a water-soluble solvent as dispersion medium. Those in which bonding of hydroxyl ions ($OH^-$) with silanol groups at the surfaces of silica particles under alkaline conditions causes mutual repulsion of respective silica particles that have acquired a negative charge such that the stability thereof can be maintained as they are dispersed in solution without bonding therebetween may be cited as examples. Moreover, the average particle diameter of primary particles in the colloidal silica might, for example, be 1 nm to 100 nm.

The description that follows is given in terms of the example of colloidal silica.

As solution (dispersion medium), this may be water, or methanol, ethanol, isopropanol, n-propanol, isobutanol, n-butanol, or other such alcohol-type solvent, ethylene glycol or other such polyhydric-alcohol-type solvent, or ethylene glycol monoethyl ether, ethylene glycol monobutyl ether, or other such polyhydric alcohol derivative, or the like. Water may be favorably employed.

In accordance with the present invention, to form a lubrication coating that contains hemimorphite, as viscosity will be low where only water-soluble zinc and colloidal silica are present, it will be necessary to cause this to adhere to the metal material surface. From the standpoints of coating forming characteristics, viscosity, and dispersion characteristics, water-soluble polymer(s) may therefore be added to the lubricant composition. As water-soluble polymer, vinyl acetate resin, carboxymethylcellulose sodium, and so forth may be cited as examples. Because vinyl acetate resin is water-soluble and is effective in terms of retention of coating forming characteristics, it is able to favorably retain hemimorphite, hemimorphite precursor substances, or water-soluble zinc and colloidal silica involved in the creation of hemimorphite at the metal material surface. Furthermore, methyl cellulose and the like are capable of imparting increased viscosity thereto.

Moreover, to cause emulsification and dispersion of the foregoing lubricant composition, a small amount of emulsifier may be added thereto. As emulsifier, known anionic surfactants, cationic surfactants, nonionic surfactants, zwitterionic surfactants, and/or other such surfactants, water-soluble macromolecules having protective colloid ability, and/or the like may be employed. As anionic surfactant, sodium laurate, sodium stearate, sodium oleate, ammonium lauryl alcohol sulfate ester, sodium lauryl sulfate ester, and so forth may be cited as examples. As cationic surfactant, methylammonium chloride, laurylammonium chloride, stearylammonium chloride, dimethylammonium chloride, trimethylammonium chloride, lauryltrimethylammonium chloride, polyoxyethylene monolauryl amine, and so forth may be cited as examples. As nonionic surfactant, polyethylene glycol lauric acid ester, polyethylene glycol oleic acid diester, glycerin oleic acid monoester, polyoxyethylene lauryl ether, polyethylene glycol distearic acid ester, and so forth may be cited as examples.

Metal soap is for imparting supplemental lubrication capability so as to be suited for more efficient plastic working when a lubricant composition in accordance with the present invention that creates hemimorphite is used. As metal soap, while calcium stearate, barium stearate, aluminum stearate, and so forth may be cited as examples, there is no limitation with respect thereto. Furthermore, because polyethylene has a low melting point, and because by melting on the die surface it will permit sliding thereon, it is effective for supplemental lubrication.

Moreover, hydrated lime, calcium carbonate, molybdenum disulfide, and/or carbon may be added as appropriate to the lubricant composition of the present invention. Thereamong, hydrated lime and/or calcium carbonate may function as carrier agent. Furthermore, molybdenum disulfide and/or carbon would be added with the goal of reducing friction and reducing seizing.

Furthermore, to improve rust preventability as a result of the lubrication coating, nitrite and/or metal sulfonate may be added to the lubricant composition. As nitrite, while sodium nitrite may be cited as example, there is no limitation with respect thereto so long as rust preventability is improved thereby. As metal sulfonate, calcium sulfonate, sodium sulfonate, barium sulfonate, and so forth may be cited as examples.

It is preferred that the lubricant composition be prepared in such fashion that the pH thereof is maintained at a pH of 10 to 12. By maintaining the alkalinity thereof, because there will be production of a passivation coating at the surface layer when a metal material is immersed therein, this will improve rust preventability, and will also suppress occurrence of rust due to exposure in air during long-term storage.

Furthermore, while a lubricant composition in accordance with the present invention may be such that, after a lubricant composition containing water-soluble zinc and colloidal silica has been made to adhere to metal material, at the time of deformation as a result of plastic working, formation of hemimorphite causes formation thereof as a lubrication coating at the surface of the metal workpiece, it is moreover also possible to cause hemimorphite to be dispersed in advance within the lubricant composition in advance. While the hemimorphite used in such case may be such that natural-mineral-derived or synthetic hemimorphite in the form of fine powder is dispersed therein, this may alternatively be such that gel-like hemimorphite and precursor substances thereof are made to be present within a lubricant composition solution.

Synthetic hemimorphite in the form of fine powder might for example be created after a lubricant composition containing water-soluble zinc and colloidal silica in accordance with the present invention has been formed into a coating under the pressure such as plastic forming and pulverized of that coating; or alternatively, it may be obtained after a gel-like substance containing hemimorphite is dried and solidified, when this is pulverized.

The gel-like substance containing hemimorphite might, for example, be obtained by the following procedure. After appropriate addition of $H_2O$ to a solution obtained by mixing water-soluble zinc and colloidal silica in amounts such as will cause the Zn:Si molar ratio to be approximately 4:2, this may be heated to 80° to 90° C. to obtain the gel-like substance as a result of formation thereof in this solution.

Figure 6:
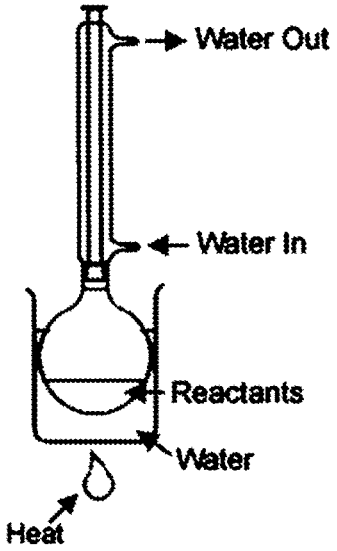
FIG. 6 Schematic diagram of reflux apparatus used for heated synthesis of hemimorphite.

For example, 1814 g of Chelest Zn (Chelest Corporation) and 347 g of colloidal silica (AT-30 manufactured by Adeka Corporation) were diluted in an equal quantity of pure water, and the apparatus shown in FIG. 6 was thereafter used to heat this for 18 hours while refluxing at 85° C., upon which there was creation—in the solution that had initially been colorless and transparent—of a white gel-like substance after 18 hours had elapsed. Thereupon the liquid as it existed prior to heating and the white gel-like substance that was created were respectively dried, and the residues were measured using an x-ray diffraction device. Results are shown in FIG. 1. A MiniFlex 600 (manufactured by Rigaku)

x-ray diffraction device was used to carry out measurement, measurement being performed over the range for which 2θ was 5 deg to 90 deg, at 40 kV, 15 mA output, and 0.0200 deg step width. As shown in (a) at FIG. 1, it was more or less amorphous prior to gel formation. On the other hand, following gel formation, as shown in (b) at FIG. 1, in addition to the fact that the Chelest Zn peaks were observed toward a lower angle, hemimorphite peaks were observed.

Figure 2:
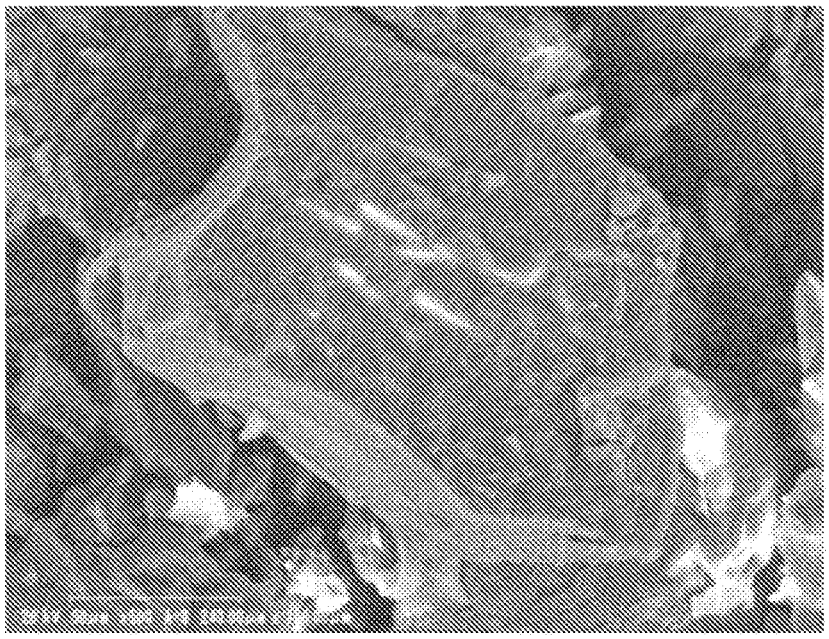
FIG. 2 Secondary electron image produced by a scanning electron microscope of the substance used at (b) in FIG. 1.

The white gel-like substances that had been dried and solidified were observed under SEM. Results are shown at FIG. 2 in the form of a secondary electron image.

Furthermore, upon performing simple identification of the surface of the solid substance by EDX, it was indicated that the compositional ratio of Si and Zn in units of at % was Zn=47.7% and Si=25.6%. Although compositional indications resulting from EDX contain large errors and should thus be considered as being for reference purposes only, Zn:Si was close to the 4:2 molar ratio of Zn and Si in hemimorphite, and the indicated result was not inconsistent with the results obtained by x-ray diffraction.

Note that while when colloidal silica is present in excess it is sometimes the case that this will facilitate gel formation, adjusting the molar ratio of Zn and Si raw materials in advance to agree with the molar ratio of Zn and Si in hemimorphite so as to cause reaction to proceed smoothly will reduce the tendency for trouble to occur and will make it such that there is no interference with creation of hemimorphite even when hemimorphite precursor substances are present during the course of creating hemimorphite.

Because it is possible to obtain a substance containing synthetic hemimorphite in accordance with the foregoing procedure, it is possible to employ as lubricant composition raw material the white gel-like substance or the powder obtained by fine pulverization following drying of the white gel-like substance. Moreover, with regard to the particle size distribution of hemimorphite made to be present in advance in solution, the volume mean diameter may be ascertained by for example using a Microtrac (laser diffraction/scattering method) to measure the volume distribution thereof. In this regard, grading may be carried out as appropriate to adjust particle size.

Below, embodiments of the present invention are described in terms of the working examples that follow. The present invention is of course not limited only to these working examples.

Working Example 1

As an example of a solution in accordance with the present invention, the following components were mixed to obtain a lubricant composition.

Chelest Zn: 5%;
Adelite AT-30: 1.2%;
Calcium stearate: 3%;
Calcium carbonate: 2.5%; and
Pure water: Remaining portion As the foregoing exemplary blending ratios are merely given by way of example, there is no limitation with respect thereto; for example, in addition to Working Example 1, keeping the molar ratio of Zn and Si at 4:2, further adding soluble polymer in the form of acetate emulsion resin, calcium stearate, polyester, molybdenum disulfide, calcium sulfonate, emulsifier, and/or the like, and adjusting pH to on the order of 10 is also a favorable example of the present invention. Added substance(s) may be appropriate combinations chosen from among those presented in the foregoing descriptions.

Furthermore, the aforementioned white gel-like substance may be created in advance by synthesis of hemimorphite, and this may be combined with acetate emulsion resin, calcium stearate, polyester, molybdenum disulfide, calcium sulfonate, emulsifier, and/or the like to obtain a lubricant composition. When this is applied to a metal material and this is subjected to cold plastic working, the pressure acting thereon will cause stable formation of a hemimorphite coating on the surface of the metal workpiece.

Alternatively, a small amount of powdered synthetic hemimorphite may be added to water-soluble polymer to obtain a lubricant composition that is capable of forming a coating. In this case as well, calcium stearate, polyester, molybdenum disulfide, calcium sulfonate, emulsifier, and/or the like may be combined therewith as appropriate.

Testing for Evaluation of Lubricity

To evaluate lubricity, Bowden testing, ring compression testing, and backward extrusion testing were carried out.

Bowden Testing

Bowden testing refers to testing using a reciprocating-type sliding friction tester which permits measurement of the coefficient of dynamic friction by causing sliding to occur while a point load is applied between a test piece and a spherical contact.

First, as test pieces, JIS (Japanese Industrial Standards) SCM 435 wire rod (serving as metal material) of diameter 5.5 mm was descaled in hydrochloric acid (18%), and after rinsing with water this was immersed for 1 minute in lubricant composition (1-1 and 1-2) in accordance with the present invention, these were dried for 1 minute and were thereafter again immersed therein for 1 minute, and a dryer was used to dry the lubricant composition adhering to the surface of the wire rod, in which state the test materials (Target Material 1-1 and Target Material 1-2) were prepared.

Furthermore, for comparative purposes, wire rod that was similar but at which instead of causing lubricant composition in accordance with the present invention to adhere thereto was subjected to phosphate coating treatment and thereafter immersed in Na soap (bonderization/lubricant carrier treatment=Comparative Material 1-1), that was subjected to zinc phosphate treatment and thereafter immersed in lime soap (bonderized/lime=Comparative Material 1-2), and that was akin to that which was subjected to lime soap (Comparative Material 1-3) were prepared.

Next, a wiredrawing die was used to draw the test materials until the diameters thereof went from 5.5 mm to 5.25 mm to obtain test pieces. A Bowden-type tester was used to carry out sliding testing in which these test pieces were made to engage in reciprocating motion under testing conditions which were such that sliding speed was 20 mm/min and stroke was 10 mm with a load of 5 Kgf being imparted thereto by a stationary pin (made of SUJ-2) that was 5 mm in diameter. Sliding was carried out repeatedly, and the number of times that sliding had to be carried out to cause the coefficient of friction to rise until 0.25 was reached was recorded.

Results (number of times sliding had to be carried out) of such Bowden testing are shown in TABLE 1.

Target Material 1-1: This had the lubricant composition of Working Example 1 adhering thereto.

Target Material 1-2: This had a lubricant composition adhering thereto which was such that the water-soluble zinc of Working Example 1 was changed from Zn chelating agent to Zn alkoxide.

Comparative Material 1-1: This was immersed in Na soap following phosphate coating treatment (bonderization/lubricant carrier treatment)

Comparative Material 1-2: This was immersed in lime soap following zinc phosphate treatment (bonderized/lime)

Comparative Material 1-3: This was immersed in lime soap

Comparative Material 1-4: That which adhered thereto was the lubricant composition of Working Example 1 without the colloidal silica Comparative Material 1-5: That which adhered thereto was the lubricant composition of Working Example 1 without the water-soluble zinc chelating agent

TABLE 1

| Number of Times Sliding Had To Be Carried Out for Coefficient of Friction to Reach 0.25 | |
|---|---|
| Target Material 1-1: | 6200 times |
| Target Material 1-2: | 6695 times |
| Comparative Material 1-1: | 5004 times |
| Comparative Material 1-2: | 1393 times |
| Comparative Material 1-3: | 843 times |
| Comparative Material 1-4: | 1846 times |
| Comparative Material 1-5: | 890 times |

In accordance with this testing, a lubricant for which the number of times that sliding has to be carried out for the coefficient of friction to reach 0.25 is 3000 or more can be evaluated as excellent in terms of the practical lubricity thereof.

From the results of testing shown in TABLE 1, it was confirmed that those at which a lubricant composition in accordance with the present invention had been made to adhere were as good as or better than those at which there was bonderized/lime or bonderization/lubricant carrier treatment involving phosphate coating treatment. And based on the fact that this was strong with respect to repeated sliding, this may be taken as indication that the properties thereof would be capable of being maintained and that lubrication would not easily be exhausted during deformation in the context of plastic working.

Where as indicated at Comparative Material 1-4 and Comparative Material 1-5 either water-soluble zinc or colloidal silica is missing from what would otherwise be the lubricant of the present invention, ability to perform as lubricant composition was such that there was dramatic decrease in the number of times that sliding had to be carried out.

Ring Compression Testing

A press was used to compress ring-shaped test pieces of outside diameter 15 mm, inside diameter 7.5 mm, and height 5 mm, and the coefficient of friction of the rings as they existed following working was determined. Because the phenomenon by which use of planar pressure plates to compress a ring-shaped test piece causes there to be a change in the inside diameter thereof following compression depending on the interfacial lubricative state that existed thereat is known, this may be adopted to determine coefficient of friction. Using test pieces respectively including Target Material 2 that was a ring at which a lubricant composition in accordance with Working Example 1 of the present invention had been made to adhere, Comparative Material 2-1 that was a ring which was subjected to phosphate coating treatment and thereafter immersed in Na soap, and Comparative Material 2-2 that was a ring which was immersed in lime soap, the coefficients of friction thereof were measured when height following compression by the press was 50 mm, and when this was 60 mm. Results are shown in TABLE 2.

TABLE 2

| | |
|---|---|
| Target Material 2: | 50 mm: 0.108 |
| | 60 mm: 0.097 |
| Comparative Material 2-1: | 50 mm: 0.100 |
| | 60 mm: 0.090 |
| Comparative Material 2-2: | 50 mm: 0.130 |
| | 60 mm: 0.117 |

At ring compression testing as well, it was indicated that lubricity of the Target Material at which a lubricant composition in accordance with the present invention had been made to adhere was vastly superior to that of lime soap, and that the lubricative performance thereof was close to that of that which was subjected to phosphate coating treatment and thereafter immersed in Na soap.

Backward Extrusion Testing

Figure 3:
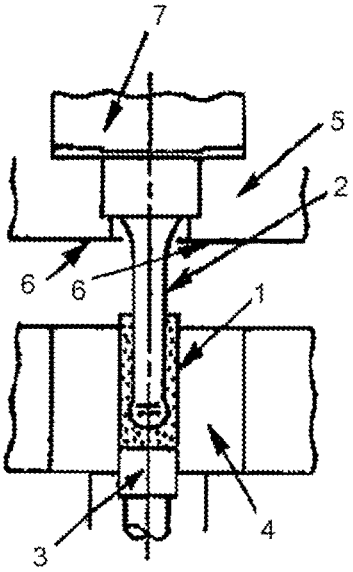
FIG. 3 Schematic diagram of apparatus employed during backward extrusion friction testing.

The backward extrusion friction testing procedure was such that sample (1) was placed within the internal space of cylindrical die (4) shown in FIG. 3, the front thereof was closed off by knockout punch (3), and punch (2) was pressed thereagainst from a central location behind sample (1) so as to be directed toward the front, causing the outside circumference of sample (1) to be extruded backward in cylindrical fashion. The backward extrusion load at that time was measured using strain gauge (6) provided at punch holder (5).

Using a H1F200S-11 (manufactured by Komatsu) as tester, backward extrusion testing was carried out on Samples 3a to 3l, below, at which the various lubricants were made to adhere, and the lubricities thereof were evaluated.

Sample 3a: Comparative Example 3-1: Bonderization/lubricant carrier treatment. Sample was subjected to bonderization (zinc phosphate coating) and was thereafter rinsed with water and immersed in lubricant carrier solution having sodium soap as primary component. Sodium soap reacted with the bonderized coating, created zinc soap at the surface layer, and exhibited satisfactory lubricity.

Sample 3b: Comparative Example 3-2: Bonderized/lime. Zinc phosphate coating was created on sample, and this was thereafter rinsed with water, immersed in lime soap solution, and dried.

Sample 3c: Comparative Example 3-3: Lime soap. Mixture was created on sample by metathetical reaction between hydrated lime (or quicklime) and sodium stearate. Primary component of created components that adhered thereto was a mixture of calcium stearate and hydrated lime.

Sample 3d: Inventive Example 3-1: Lubricant composition comprising water-soluble zinc (Chelest Zn) and colloidal silica (Adelite AT-30), with the remaining portion being pure water, was made to adhere to sample.

Sample 3e: Inventive Example 3-2: Lubricant composition having components as at Sample 3d was applied thereto and this was thereafter heated for 2 hours at 105° C.

Sample 3f: Inventive Example 3-3: Lubricant composition comprising water-soluble zinc (Chelest Zn) and colloidal silica (Adelite AT-30) and molybdenum disulfide, with the remaining portion being pure water, was made to adhere to sample.

Sample 3g: Inventive Example 3-4: Lubricant composition comprising water-soluble zinc (Chelest Zn) and colloidal silica (Adelite AT-30) and barium stearate, with the remaining portion being pure water, was made to adhere to sample.

Sample 3h: Inventive Example 3-5: Lubricant composition comprising water-soluble zinc (Chelest Zn) and colloidal silica (Adelite AT-30) and water-soluble polymer, with the remaining portion being pure water, was made to adhere to sample.

Sample 3i: Inventive Example 3-6: Lubricant composition comprising water-soluble zinc (Chelest Zn) and colloidal silica (Adelite AT-30) and powdered carbon, with the remaining portion being pure water, was made to adhere to sample.

Sample 3j: Inventive Example 3-7: Lubricant composition comprising water-soluble zinc (Chelest Zn) and colloidal silica (Adelite AT-30) and barium stearate and water-soluble polymer, with the remaining portion being pure water, was made to adhere to sample.

Sample 3k: Inventive Example 3-8: Lubricant composition comprising water-soluble zinc (Chelest Zn) and colloidal silica (Adelite AT-30) and barium stearate and molybdenum disulfide, with the remaining portion being pure water, was made to adhere to sample.

Sample 3l: Inventive Example 3-9: Lubricant composition comprising water-soluble zinc (Chelest Zu) and colloidal silica (Adelite AT-30) and barium stearate and molybdenum disulfide and water-soluble polymer and powdered carbon, with the remaining portion being pure water, was made to adhere to sample.

TABLE 3

| | |
|---|---|
| Comparative Example 3-1: | 849 kN |
| Comparative Example 3-2: | 862 kN |
| Comparative Example 3-3: | 858 kN |
| Inventive Example 3-1: | 849 kN |
| Inventive Example 3-2: | 844 kN |
| Inventive Example 3-3: | 840 kN |
| Inventive Example 3-4: | 842 kN |
| Inventive Example 3-5: | 840 kN |
| Inventive Example 3-6: | 844 kN |
| Inventive Example 3-7: | 836 kN |
| Inventive Example 3-8: | 840 kN |
| Inventive Example 3-9: | 825 kN |

Because an extremely large force is applied to the test piece surface during backward extrusion testing, it constitutes testing in which lubricative performance is ascertained under extremely severe conditions; the lower the load required when carrying out working to achieve a prescribed shape the higher the lubricity of the evaluation it will be capable of receiving.

Figure 7:
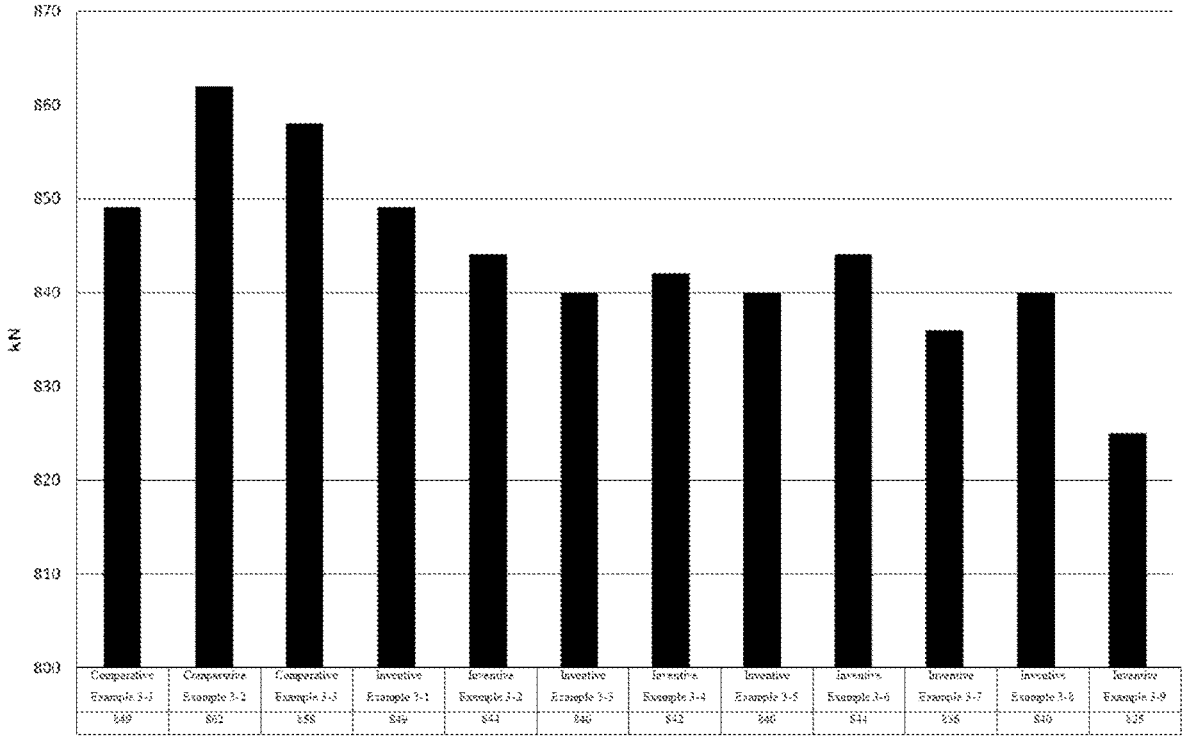
FIG. 7 Bar graph showing results (in units of kN) of backward extrusion testing at TABLE 3.

The results of the backward extrusion testing at TABLE 3 are shown in the form of a bar graph at FIG. 7. As Comparative Example 3-1 is the result of testing for bonderization/lubricant carrier treatment which was best in terms of phosphate coating treatment, using Comparative Example 3-1 as reference, the lubricant composition consisting of water-soluble zinc and colloidal silica in accordance with the present invention at Inventive Example 3-1 exhibited lubricity equivalent to that of bonderization/lubricant carrier treatment.

Moreover, when barium stearate, molybdenum disulfide, water-soluble polymer, powdered carbon, and/or the like were further added in the lubricant composition of the present invention as at Inventive Example 3-3 to Inventive Example 3-9, it was confirmed that lubricity was further improved as compared with Inventive Example 3-1.

At Inventive Example 3-2, because, prior to backward extrusion testing, as a result of causing lubricant composition to adhere thereto, in which state it was dried through application of heat, it was in a state in which hemimorphite had formed on the surface, lubricity was improved.

As described above, a lubricant composition employing Working Example 1 in accordance with the present invention was such that the lubricity thereof was higher than that with treatment involving lime soap, the properties thereof being adequate in tenors of lubricative performance during plastic working of a metal workpiece, and exhibited a practical lubricity equivalent to, being not worse than, that with bonderization/lubricant carrier treatment. Because it is able to ensure practical lubricity while also achieving a phosphorous-free constitution, it is therefore able to provide practical lubricative performance while also avoiding a causal factor of delayed fracture, and because it is moreover able to impart lubricity without requiring that unwanted additional procedures be introduced into existing operations, it imposes few constraints on manufacturing operations in situations where lubricant compositions are employed.

Hemimorphite within Lubrication Coating

Figure 4:
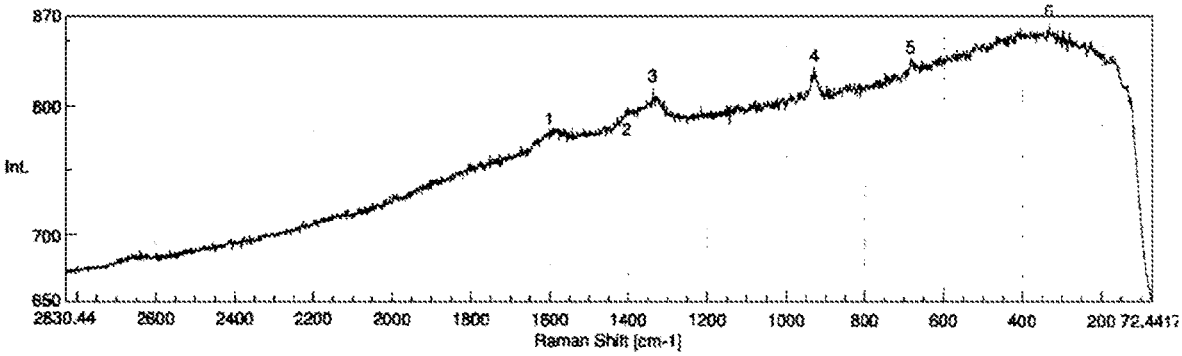
FIG. 4 Results of Raman spectroscopic analysis of coating surface at Target Material 1 to which the lubricant composition of Working Example 1 was made to adhere.
Figure 5:
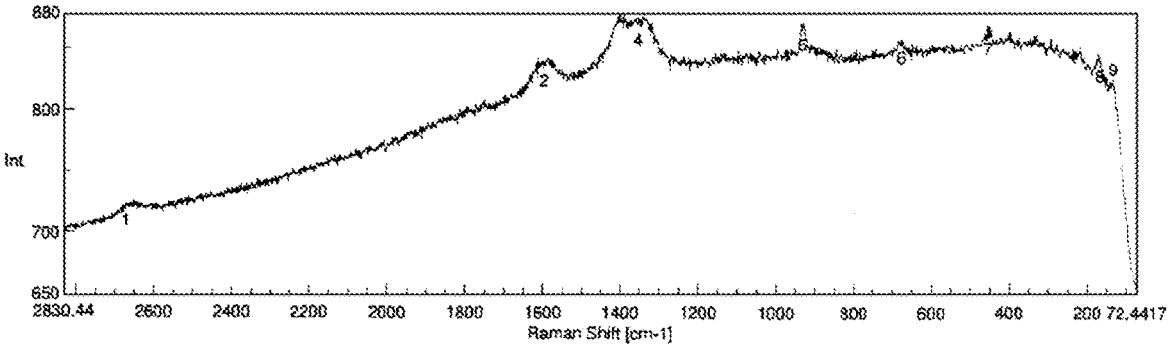
FIG. 5 Drawing provided for reference purposes of Raman spectroscopic analysis of natural crystals of hemimorphite.

Next, Raman spectroscopic analysis was used to observe hemimorphite within the lubrication coating at the surface of Target Materials 1 after this had been used at Bowden testing. Results of Raman spectroscopic analysis are shown in FIG. 4. FIG. 5 shows the results of observation of the surface of natural hemimorphite by means of Raman spectroscopic analysis for comparative purposes.

As the Raman spectral peak at the lubrication coating of FIG. 4 matched the location of the peak seen at the natural hemimorphite of FIG. 5, it was identified as hemimorphite. It was thus confirmed that when the lubricant composition of Working Example 1 is applied to a metal material and the metal workpiece is made to undergo plastic deformation, the mere fact that working involving plastic deformation causes pressure to be applied to the coating surface is enough to cause creation of hemimorphite crystals in the lubrication coating even when at room temperature or under other such low-temperature ambient conditions.

Employment of Lubricant Composition of Present Invention at Metal Material Surface While the lubricant composition of the present invention is used by causing it to adhere to the surface of a metal material, in causing it to adhere to the metal material surface, the metal material might be immersed in a solution of the lubricant composition, or a solution of the lubricant composition might be applied to or sprayed on the metal material, it being possible to employ any of various means such as causing the lubricant composition to adhere to the surface of the metal material and so forth. Regardless of what means is employed to cause it to adhere thereto, because the metal material at which the lubricant composition adheres to the surface will be such that this will be capable of undergoing plastic working as a metal workpiece, and such that when some stress acts thereon at room temperature or under such other low-temperature condition during such plastic working thereof, the pressure therefrom will cause creation of hemimorphite, it will be possible to form a lubrication coating at which hemimorphite is present at the surface of the metal workpiece. Because the surface of this metal workpiece will be imparted with lubricity by the lubrication coating, it will be possible for it to subsequently undergo forging or other such working. And because this lubrication coating will tend not to change due to absorption of moisture or the like, it will be capable of retaining its properties in stable fashion for a long period of time.

Furthermore, causing a lubricant composition which contains natural or synthetic hemimorphite to be applied to a metal material surface will make it possible to impart lubricity thereto.

Metal materials and metal workpieces that have undergone coating treatment in such fashion will be excellent in terms of their lubricative performance and rust preventability. As an example of a metal workpiece, steel wire on which a hemimorphite-containing lubrication coating is formed will therefore be such that the steel wire will be capable of being adequately drawn into fine wire by means of a die without the need to further impart supplemental lubricant thereto.

Rust Preventability

Humidity testing was carried out in which respective steel rods of Target Material 4 at which the lubricant composition of Working Example 1 was made to adhere, Comparative Material 4-1 which was immersed in Na soap following phosphate coating treatment, and Comparative Material 4-2 which was immersed in lime soap were left undisturbed for 24 hours in humid ambient conditions of saturated humidity. Furthermore, indoor exposure testing was carried out for 1 week.

As a result, with the lime soap at 4-2, much rust was observed to have occurred as a result of humidity testing for 24 hours, and the entire surface thereof was severely corroded as a result of exposure testing for 1 week. With the bonderization at 4-1, locations at which there was sporadic formation of rust were observed as a result of humidity testing for 24 hours. Furthermore, with exposure testing for 1 week, progress of rust was observed not over the entire surface but at portions thereof. In contradistinction thereto, Target Material 4 exhibited high rust preventability, occurrence of rust not being observed as a result of humidity testing for 24 hours. With exposure testing for 1 week, while progress of rust was observed at portions thereof, the degree to which progress of rust formation had occurred was on a level that was equivalent to or better than with bonderization, and higher rust preventability than with lime soap was exhibited thereby.

As described above, use of a lubricant composition in accordance with the present invention makes it possible to obtain a lubrication coating that as compared with a conventional lubrication coating has the following characteristics.

(1) Because a lubricant composition in accordance with the present invention does not contain phosphorous, when a metal workpiece at which a lubrication coating has made to adhere or a metal workpiece which is such that a product further subjected to secondary working is made to undergo quenching, there will be no concern that this could lead to occurrence of delayed fracture due to the phosphorization phenomenon which is a concern with zinc phosphate and other such chemical conversion treatments.

(2) Because lubricative performance is dramatically better than that with widely known existing lubrication by means of lime soap, and the lubricity exhibited thereby is excellent, being equivalent to or better than that with zinc phosphate treatment coating, it is a lubrication coating which is capable of being employed even in the context of cold forging or other such plastic working at which there had conventionally been no choice but to rely on zinc phosphate treatment.

(3) Because the degree of alkalinity thereof is less than with silicate-type lubricants, it permits suppression of occurrence of scum at the time of immersion.

(4) Because there is no employment of boron among the lubrication components thereof, a lubricant composition in accordance with the present invention has little environmental impact when discarded as waste liquid, and is gentler on the environment than would be the case with a lubricant in which B was present among the components thereof.

(5) Because where a lubricant composition in accordance with the present invention is employed there will tend not to be occurrence of sludge of the type that occurs during phosphate treatment, it is better from the standpoint of the environment.

(6) Whereas bonderization and other such chemical conversion treatment requires that rinsing with water be carried out following chemical conversion treatment, because a lubricant composition in accordance with the present invention is of the adhesion type by which a lubrication coating is made to adhere thereto and is formed thereon, there is no production of waste liquid such as would accompany rinsing with water, and so from this standpoint as well the environmental impact thereof is small.

(7) A lubricant composition in accordance with the present invention will make it possible to obtain a coating that not only has excellent lubricity but that also is extremely superior with respect to rust preventability.

(8) Because a lubricant composition in accordance with the present invention is of the adhesion type, not only does it permit reduction in treatment time, but because it also does not increase the number of operations that must be carried out, it has a wide scope of application, inasmuch as it facilitates employment in an existing production line, is capable of accommodating inline treatment, and so forth.

(9) A lubricant composition in accordance with the present invention will not lead to occurrence of bad plating such as is the case with waterglass-type lubricants.

EXPLANATION OF REFERENCE NUMERALS

1 Sample
2 Punch
3 Knockout punch
4 Die
5 Punch holder
6 Strain gauge
7 Load cell

The invention claimed is:

1. A lubricant composition for causing formation of a hemimorphite-containing lubrication coating that contains a colloidal silica compound and water-soluble zinc in solution, wherein the water-soluble zinc in solution comprises zinc oxide and a chelating agent.

2. The lubricant composition according to claim 1 further comprising a water-soluble polymer.

3. The lubricant composition according to claim 1 further comprising at least one of metal soap and/or polyethylene.

4. The lubricant composition according to claim 1 further comprising at least one of hydrated lime, calcium carbonate, molybdenum disulfide, and/or carbon.

5. The lubricant composition according to claim 1 further comprising at least one of nitrite and/or metal sulfonate.

6. A hemimorphite-containing lubricant, comprising a colloidal silica compound and water-soluble zinc in solution, wherein the hemimorphite of the hemimorphite-containing lubrication is synthetic hemimorphite synthesized from water-soluble zinc and colloidal silica in solution.

7. The hemimorphite-containing lubricant composition according to claim 6, wherein the hemimorphite consists of particles for which the volume mean diameter thereof is not greater than 10 μm.

8. The hemimorphite-containing lubricant composition according to claim 6 wherein it contains gel-like synthetic hemimorphite.

9. A method for forming a hemimorphite-containing lubrication coating wherein the hemimorphite-containing lubricant composition according to claim 8, the method comprising the step of coating the lubrication composition to a surface of a metal material; the metal material undergoes plastic working as a metal workpiece, and a lubrication coating that contains hemimorphite is formed on a surface of the metal workpiece at a time when there is deformation as a result of the plastic working thereof.

10. A metal workpiece at which a lubrication coating that contains hemimorphite is formed at a surface thereof by means of the lubricant composition according to claim 1.

11. The lubricant composition according to claim 1, wherein the chelating agent is ethylenediaminetetraacetic acid.

* * * * *